United States Patent [19]

Saraga

[11] Patent Number: 4,704,878

[45] Date of Patent: Nov. 10, 1987

[54] EARRING

[76] Inventor: Pepe Saraga, 13910 Old Harbor La. #106, Marina del Rey, Calif. 90392

[21] Appl. No.: 768,825

[22] Filed: Aug. 22, 1985

[51] Int. Cl.[4] ..... A44C 7/00

[52] U.S. Cl. ..... 63/14 R; D11/42

[58] Field of Search ..... 63/14 R, 14 A, 14 B, 63/14 G, 12, 13; D11/42, 43

[56] References Cited

U.S. PATENT DOCUMENTS

| | | | |
|---|---|---|---|
| 20,480 | 6/1858 | Carpenter | 63/14 A |
| D. 155,511 | 10/1949 | Janouset | D11/42 |
| D. 189,793 | 2/1961 | Howard | 63/14 R |
| 2,511,170 | 6/1950 | McCann | 64/14 A |
| 2,610,486 | 9/1952 | McCann | 63/14 A |

FOREIGN PATENT DOCUMENTS

| | | | |
|---|---|---|---|
| 947523 | 8/1956 | Fed. Rep. of Germany | 63/14 R |
| 433886 | 8/1935 | United Kingdom | 63/14 A |

OTHER PUBLICATIONS

BJ's Hookers, advertizing brochure of Barbara J. Barnett, Laguna Beach, CA, 12/1984.

*Primary Examiner*—Richard J. Johnson

*Attorney, Agent, or Firm*—Blakely, Sokoloff, Taylor & Zafman

[57] ABSTRACT

An earring for mounting on a human ear without the necessity for compressive force or piercing of the ear. The earring includes first and second mounting members for mounting the earring on the ear. The mounting members are coupled by a connecting member which defines the shape of the earring and maintains a spacial relationship between the first and second mounting members. When in place, the first mounting member contacts the ear on the back outer portion of the ear while the second mounting member contacts the ear on the inside of the antihelix of the ear. The ends of the mounting members are separated by a distance sufficient to allow placement of the earring on the ear. This spacial relationship between the first and second mounting members can be described by lines extending through each mounting member and intersecting at the origin of an imaginary three dimensional XYZ coordinate system. If the line extending through one of the mounting members lies on the positive X axis of the coordinate system, the line extending through the other mounting member and through the origin of the coordinate system will lie on the surface of a cone having its apex at the origin of the coordinate system and defined by the equation $KX=-\sqrt{Y_2+Z^2}$, where K is in the range 1.00 to 3.73 and where X is less than or equal to zero.

7 Claims, 4 Drawing Figures

EARRING

BACKGROUND OF THE INVENTION

1. Field of the Invention

This invention relates to the field of ornaments for the ear, commonly known as earrings.

2. Prior art

It is often desired by a person to wear a decorative ornament on the ear. In the past, two methods have been successfully utilized for affixing ornaments to the ear. The first method consists of an earring which clamps itself on the earlobe and is held in place by the compressive force of the clamp. There are many disadvantages associated with this method. First, if the compressive force is not great enough, the earring tends to fall off the ear. This is a particular problem during periods of high activity by the wearer of the earring such as running, dancing, or exercise. Second, if the compressive force is great enough to retain the earring on the ear, it is often so great that it causes discomfort to the wearer, particularly because the earlobe is very sensitive. As a result, such earrings cannot be worn for extended periods of time.

The second successful prior art method of affixing ornamentation to an ear is by piercing the wearer's ear in the earlobe area and inserting a portion of an earring through the opening in the earlobe and applying a retention device behind the ear to hold the earring in place. There are disadvantages associated with this method as well. For example, the wearer may not wish to pierce his or her ear for fear of infection, or discomfort. In addition, if the earring were to get caught, there is the potential that the earring could be pulled through the lobe, tearing the lobe.

Therefore, it is an object of the present invention to overcome the disadvantages of prior art earrings by providing an ornamental earring which does not utilize compressive force to retain the earring on the wearer's ear. Additionally, the earring does not require that the ear be pierced in order that the earring be retained on the wearer's ear.

Prior art earrings and ornaments include McCann, U.S. Pat. Nos. 2,511,170; Haynes, 3,828,577; Howard, U.S. Pat. No. Des. 189,793 and Janousek, U.S. Pat. No. Des. 155,511.

McCann discloses an earring which is designed to stay in place without piercing the ear or the use of compressive force. The earring of McCann includes "wings" which rest on the inner face of the tragus of an ear. An extending member coupled to the earring is positioned behind the lobe of the ear to provide additional support. The earring of McCann has the disadvantage of requiring adjustment of the wing for each individual user as well as positioning of a portion of the wing near the ear canal with an increased likelihood of penetration to the inner ear and ear drum. Therefore, it is a further object of the present invention to provide an earring which mounts at a single point on either side of an ear at a location away from the ear canal.

Haynes teaches a nose ornament consisting of an open loop which is attached to the nose and kept in place without the use of compressive force. The nose ornament includes a sachet coupled to the ornament to provide an odorous element to the device. There is no suggestion to use the nose ornament of Haynes as an earring, when in fact such a use would defeat the purpose of the sachet element of the device.

Howard and Janousek each disclose open loop earrings. Neither reference discloses the novel earring disclosed herein.

SUMMARY OF THE PRESENT INVENTION

The earring of the present invention attaches to a wearer's ear and remains in place without the use of compressive force or the need to pierce the wearer's earlobe. The earring is comprised of a substantially rigid material, which material either returns by itself or may be returned to its original configuration when deformed. For example, the earring may be comprised of spring steel or hard plastic. The earring is attached to the ear by two mounting members. The first member is inserted over the lobe of the ear and rests against the junction of the antitragus and antihelix. The second mounting member contacts the ear behind the lobe approximately directly opposite the antihelix. The earring of the present invention is formed such that, once in place, movement of the earring is restricted by contact of these mounting members with the ear.

The earring of the present invention consists of an open loop. The gap of the loop may be widened by the user for placement of the earring on the ear. Once in place the earring returns to its original configuration, reducing the gap sufficiently to hold the earring in place with no necessary reliance on compressive force. The ends of the loop are mounting members used to hold the earring in place on the ear. The mounting members have a unique angular relationship to each other which can be described by the angle of intersection of vectors extending through each respective member. That is if one of the mounting members is considered to be coincident with the X-axis in an XYZ coordinate system, then the other mounting member would lie on the surface of a cone described by the equation $KX-\sqrt{Y^2+Z^2}$ where K is a constant between, and including 1.0 and 3.73.

DETAILED DESCRIPTION OF THE PRESENT INVENTION

Figure 1:
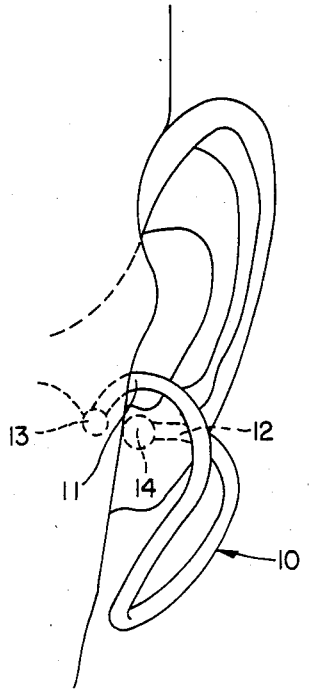
FIG. 1 is a front view of the present invention in place on an ear.
Figure 2:
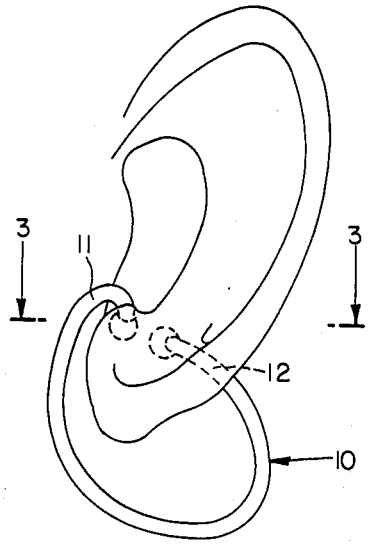
FIG. 2 is a side view of the present invention shown in FIG. 1.
Figure 3:
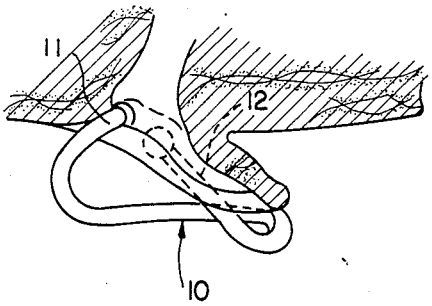
FIG. 3 is a sectional view of the ear and earring of FIG. 2, generally taken along line 3—3 of FIG. 2.

Referring to FIGS. 1 through 3, the earring of the present invention is shown in use as attached to a human ear. The preferred embodiment of the present invention comprises generally an open loop. Mounting members 11 and 12 are disposed adjoining the opening of the loop. Each of the mounting members terminates in a sphere, such as sphere 13 at the end of member 11 and sphere 14 at the end of member 12. These spheres are not required, but provide greater comfort to the wearer at points of contact between the earring and the ear. There is a gap between the mounting members so that the earring may be placed on the ear. In the presently preferred embodiment a gap of approximately 1/16 to 7/16 inches results in ease of application and a comfortable fit.

The earring should be comprised of a substantially rigid material which will return to or can be returned to its original shape after a deforming force has been applied. The earrings should be sufficiently resilient so that the gap between mounting members 11 and 12 may be widened for placement of the earring on an ear. The earring should then return to or be returned to its original shape so that the earring may be retained on the ear.

In the preferred embodiment, the earrings are comprised of spring steel, which is resilient, yet returns to its original shape. With such a construction, the gap between the mounting members can be widened for easy mounting on the ear with the earring returning to its original shape to securely hold the earring on the ear. Other suitable materials include hard plastics.

Figure 4:
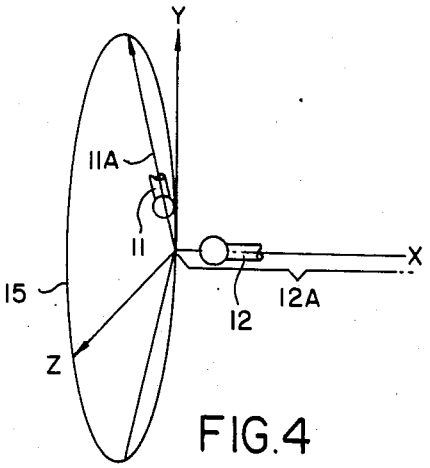
FIG. 4 is a view of the angular relationship of the mounting members in an XYZ coordinate system.

The mounting members of the present invention define an angle which has been found to be of great advantage in retaining the earring in place. If the line extending through mounting member 12 is considered to be a line extending along the positive X axis of an XYZ coordinate system with mounting member 12 placed as shown in FIG. 4, then the line extending through mounting member 11 and through the origin of the coordinate system, would be along the surface of a volume defined by the relationship $KX=\sqrt{Y^2+Z^2}$ where K ranges from 1.00 to 3.73. The relationship is shown in FIG. 4. The origin of the coordinate system lies at the point of intersection of the lines extending through mounting members 11 and 12.

As shown in FIG. 4 the surface represented by the equation described above is a right circular cone. It is further noted that when line 12*a* lies along the positive X axis, the equation describing the surface 15 is satisfied when X is less than or equal to zero. It can be seen that by rotating mounting member 12 along its axis, mounting member 11 will be colinear with a plurality of lines. However, each of these lines will maintain the same angular relationship with mounting member 12 and each line will lie on the surface of the volume 15 defined by the equation with $KX=\sqrt{Y^2+Z^2}$. Solving this equation for the case, Z=0, we see that KX equal Y. The surface 15 can be generated by rotating the line defined by this equation about the-x axis. When Z=0, the line KX equal Y may be found at between 105 to 135 degrees to the X-axis, but in the preferred embodiment is approximately 120 degrees, and K is preferrably 1.73. Although the lines extending through the mounting members are shown intersecting at the point of origin of the XYZ coordinate system, it is to be remembered that there is a displacement between the mounting members of approximately 1/16 to 7/16 of an inch.

The earring must be constructed such that that the relationship as mentioned above is maintained between the mounting members. Otherwise, the earring will not be retained on the ear securely. In the Figures, the connecting portion 18 between the mounting members is shown as a particular ornamental loop, but any configuration may be utilized so long as the angular relationship between the mounting members is maintained. The mounting members preferably are at least ¼ inch long. The length of each mounting member should be at least one-quarter of the length of the gap between the ends of the mounting members. Additionally, this connecting, or support, member may serve as a point of attachment for further ornamentation.

In the preferred embodiment the entire loop, including the mounting members, is circular on cross section, although semicircular or flat cross sections may also be used.

When in use, the mounting member 11 is inserted over the antitragus of the ear while the mounting member 12 is passed behind the earlobe. During this step, the mounting members may be pulled apart slightly to widen the gap between them and allow for easier placement on the ear. Once in place, the mounting member 11 contacts the inside of the antitragus at approximately the junction between the antitragus and the antihelix. Mounting member 12 meanwhile extends beind the earlobe approximately opposite the antihelix. This configuration allows for secure retention of the earring even during movement of the ear. If an upward force is exerted on the earring, the mounting member 12 contacts the junction between the ear and the head preventing further upward movement such that the mounting member 11 does not extend above the antitragus. During downward force on the earring the mounting member 11, extending over the antitragus, retains the earring in place. An outward force on the earring simply causes the mounting member 11 and mounting member 12 to contact the ear, preventing further motion.

By providing an earring having mounting members with a vector relationship as described above, it is not necessary to utilize compressive force to hold the earring in place. In addition, it is easily seen that no piercing of the ear is necessary on the part of the wearer prior to using these earrings. Although compressive force is not required to hold the earrings in place, a user may apply it if desired by reducing the gap between the mounting members. The resulting compressive force will be directed to an area of the ear which is less sensitive to discomfort than the lobe area.

The present invention contemplates both "right" and "left" earrings. The embodiment as described above being for a right earring. An earring for the left ear would also include two mounting members, corresponding to members 11 and 12 of the previously described earring, but arranged in mirror image to the earring for the right ear.

Thus, an earring has been described which requires no compressive force or piercing of the wearer's ear to be retained securely in position on a human ear.

I claim:

1. An earring comprising:

a connector having two ends, said connector coupled at one end to only a first mounting member and at the other end to only a second mounting member, said connector for defining said earring and maintaining a spacial relationship between said first and second mounting members;

said first mounting member contacting said ear at a point on the back outer portion of said ear when the earring is mounted on said ear;

said second mounting member contacting said ear at a point on the inside of the antitragus of said ear when the earring is mounted on said ear;

the ends of said first and second mounting members separated by a distance, each of said mounting members having a length at least one-quarter of said distance;

said second mounting member extending away from said first mounting member colinearly with a line extending from the origin of an imaginary three dimensional XYZ coordinate system and disposed on the surface of a right circular cone having its apex at said origin, wherein said first mounting member lies upon the positive X axis of said imaginary three dimensional XYZ coordinate system and said origin lies at the intersection of the lines extending through said first and second mounting members;

said cone being defined by the equation $KX=-\sqrt{Y^2+Z^2}$ where X does not exceed zero and where K is in the range from and including 1.0 to 3.73;

whereby said earring is maintained on said ear without piercing of said ear and without the necessity of application of compressive force to said ear.

2. The earring as defined by claim 1 wherein said distance is sufficient to allow mounting of said earring on said ear.

3. The earring as defined by claim 1 wherein said distance is in the range from and including 1/16 to 7/16 inches.

4. The earring as defined by claim 1 wherein said earring is comprised of a material which returns to its original shape after deformation.

5. The earring as defined by claim 1 wherein said earring is comprised of spring steel.

6. The earring as defined by claim 5 wherein said earring has a substantially circular cross-section.

7. The earring as defined by claim 1 wherein K is approximately 1.73.

* * * * *